US005988449A

United States Patent [19]

Fuchs et al.

[11] Patent Number: 5,988,449

[45] Date of Patent: Nov. 23, 1999

[54] MEDIA DISPENSER HAVING A VENT WITH A MICROBIC BARRIER

[75] Inventors: Karl-Heinz Fuchs, Radolfzell; Andreas Graf, Singen, both of Germany

[73] Assignee: Ing. Erich Pfeiffer GmbH, Radolfzell, Germany

[21] Appl. No.: 08/887,023

[22] Filed: Jul. 2, 1997

[30] Foreign Application Priority Data

Jul. 5, 1996 [DE] Germany ..... 196 27 228

[51] Int. Cl.[6] ..... B67D 5/58

[52] U.S. Cl. ..... 222/189.11; 222/321.6

[58] Field of Search ..... 222/189.11, 321.2, 222/321.6, 321.3, 380

[56] References Cited

U.S. PATENT DOCUMENTS

| | | | |
|---|---|---|---|
| 4,035,303 | 7/1977 | Ufferfilge | 222/189.11 |
| 4,694,976 | 9/1987 | Schuetz | 222/189.11 |
| 4,821,928 | 4/1989 | Su | 222/321 |
| 4,830,284 | 5/1989 | Maerte | 222/321.6 |
| 5,074,440 | 12/1991 | Clements et al. | 222/189 |
| 5,195,665 | 3/1993 | Lina | 222/321.6 |
| 5,207,659 | 5/1993 | Pennaneac'h et al. | 604/298 |
| 5,310,094 | 5/1994 | Martinez et al. | 222/212 |
| 5,370,313 | 12/1994 | Beard | 239/337 |
| 5,476,195 | 12/1995 | Odet et al. | 222/207 |
| 5,657,930 | 8/1997 | Battegazzore | 239/333 |
| 5,692,649 | 12/1997 | Schwab | 222/321.2 |

FOREIGN PATENT DOCUMENTS

| | | |
|---|---|---|
| 0 487 412 A1 | 5/1992 | European Pat. Off. . |
| 0 500 249 A1 | 8/1992 | European Pat. Off. . |
| 0 602 019 A2 | 6/1994 | European Pat. Off. . |
| 3315334A1 | 10/1984 | Germany . |
| 3503354A1 | 8/1986 | Germany . |
| 4027320A1 | 3/1992 | Germany . |
| 4110302A1 | 10/1992 | Germany . |
| 4110304A1 | 10/1992 | Germany . |
| 4027320C2 | 9/1993 | Germany . |
| 4403755A1 | 11/1994 | Germany . |
| 4400945A1 | 7/1995 | Germany . |
| 4417488A1 | 11/1995 | Germany . |
| 295 18 284 U 1 | 3/1996 | Germany . |
| 4441263A1 | 5/1996 | Germany . |
| 19605153A1 | 8/1997 | Germany . |
| 19606701A1 | 8/1997 | Germany . |
| 19606702A1 | 8/1997 | Germany . |
| 19606703 A1 | 8/1997 | Germany . |
| 19610457 A1 | 9/1997 | Germany . |

OTHER PUBLICATIONS

European search report dated Oct. 20, 1997 in European Appl. No. 97110710.7.

German search report dated Jan. 20, 1997 in German Appl. No. 19527228.9–11.

*Primary Examiner*—Philippe Derakshani

*Attorney, Agent, or Firm*—Quarles & Brady LLP

[57] ABSTRACT

A dispenser (1) including a reservoir (4), a pump (6) and an atomizing nozzle (17) has on the nozzle (17) a germ barrier (22) in the form of a valve that opens and closes dependent on pressure. A further germ barrier (23) with a filter (54) acting as a seal in the connecting area between reservoir (4) and pump (6) is provided in a venting channel (21). Both units (2, 3) of the device (1), which are actuated against each other, are prevented from being pulled apart by a snap device (50). Germ penetration into the entire dispenser (1) can be effectively prevented.

25 Claims, 4 Drawing Sheets

FIG. 5
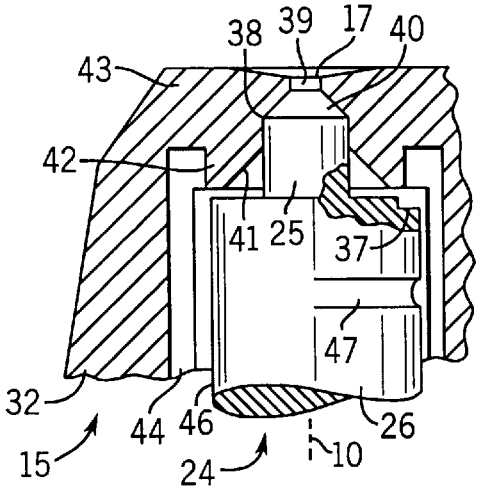
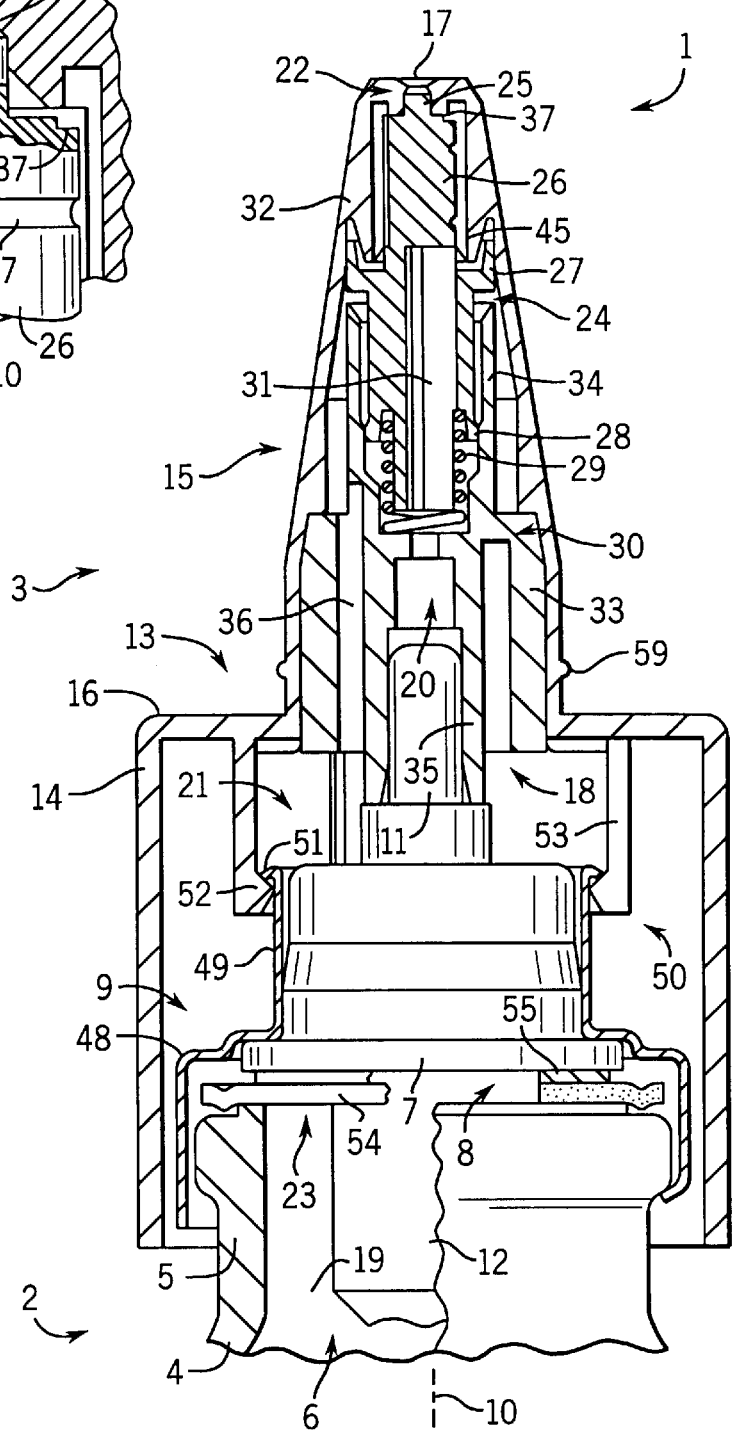
FIG. 1

MEDIA DISPENSER HAVING A VENT WITH A MICROBIC BARRIER

BACKGROUND AND SUMMARY OF THE INVENTION

The invention relates to a medium dispenser. With it media can be distributed or dispensed through a medium outlet. In so doing, the medium can have its final contact with the dispenser at this medium outlet. Such dispensers particularly have a medium or fluid duct, which can be made up of separate ducts such as channels or the like. Contrary to significantly extended medium chambers they can form significantly narrower medium chambers. The other medium chambers can be provided to store the medium, as pressure chambers to generate delivery pressure or the like. They can be connected to a medium duct at their entrance and/or exit. These serve to fill or empty the medium chamber when actuating the dispenser.

Appropriately, the fluid duct is separate from the medium duct. In the event of pressure compensation of a medium chamber the flow can be counter to the medium flow. The fluid, like atmospheric air, flows into the medium chamber, in case the latter has come under low pressure as a result of emptying, temperature change or the like. This supply of the fluid can easily result in microbic contamination of the medium. It is therefore appropriate for such ventilation ducts to run solely via a sterilizing or germ filter or the like in order to make the air throughput germ-free.

Notwithstanding that, however, germs can also penetrate into the device in the area of the medium outlet, possibly into the medium chambers, along the medium duct. This leads to microbic contamination and therefore to the medium being spoilt as well as the dispenser becoming useless. That can be countered by closing means located in the vicinity of the medium outlet. When closed, they are capable of forming a germ barrier.

Consequently, the invention is based on the object of creating a dispenser or delivery device, with which the disadvantages of known designs and respectively of the use either of only a germ barrier at the medium outlet or a germ barrier in the fluid duct are avoided and which, in particular with a simple construction, has very safe combined functions of the barriers.

According to the invention, therefore, shutting blocks or germ barriers are provided as well for the outlet as for the fluid duct. If in order to actuate delivery of the medium the dispenser has two units which can be moved against each other one barrier is appropriately held or displaceably mounted on the one unit and the other barrier on the other unit. By actuating delivery both barriers perform reciprocal motions synchroneously with the actuation.

The medium outlet, particularly an atomizing nozzle, is appropriately formed by means of the outer end of a short nozzle channel. The inner end of which can directly adjoin a conical or similar extension. It appropriately forms the closing surface of the relevant barrier. The closing surface of a movable sealing member can adjoin this closing surface in a closed state. Both closing surfaces appropriately only adjoin each other in a line-shaped and respectively ring-shaped manner. Thus extremely small creepage paths for the germs are achieved. High closing and surface pressures respectively have to be achieved. Despite non-elastically flexible closing surfaces a very tight seal is guaranteed. The nozzle channel, which is bounded to one part and forms the medium outlet with its end, can—as with the sealing member—be extended only once or multiply upstream of the closing surface. Thus the sealing member can be slidingly guided over an axial path of its opening or closing motion directly in this nozzle channel. The faces that slide together, when in a closed position, can form an additional germ barrier. It directly connects upstream to the closing surfaces that abut together axially. It clears passage for the medium only after a first partial path of the opening stroke of the sealing member.

During the closing motion the sealing member, like a pump piston, ejects in a pulsed manner the medium out of the nozzle channel through the medium outlet. Thus the nozzle channel between the end of the sealing plunger and the medium outlet is completely emptied on account of the mass inertia of the medium. The residual medium present there is expelled into the open in an atomized state.

The germ barrier for the fluid duct could be designed in accordance with DE-OS 35 03 354, to which reference is made for inclusion in the application on hand due to further characteristics and effects. Appropriately, this germ barrier can also be designed in keeping with German patent application No. 196 10 457.2, to which detailed reference is made for the same reasons.

Both actuating units that are to be moved against each other are appropriately provided with a anti-pull-off device to further protect against germ penetration. It sufficiently prevents or hinders both units being pulled apart. It is advantageous that a safety member of this safety device is formed by a holder, such as a crimp ring, which envelopes another component or is attached to the latter. The safety device is displaced from the upstream end of this holder. The safety member can lie on the outer circumference of the holder or be effective at a distance from this outer circumference. It can be produced particularly easily if it is formed by bending deformation or by edge-rasing the end of the holder. This is made of a relatively soft, e.g. metallic, material. With the safety device a germ barrier in the joint between the acutating units, e.g. on a plunger ram, cannot be opened by mistake.

It is also advantageous if this holder bounds the fluid duct with its inner circumference. Thus the accompanying germ barrier can lie completely encapsulated within the holder. Fluid inlets can be bounded at a mutual axial distance by the holder. They can be located at one or both ends of the holder within a casing of the actuating unit which has the medium outlet.

With regard to the design of the dispenser or of the respective barrier or of the respective seal, reference is furthermore made to the following documents for inclusion of the characteristics and effects in the application on hand: DE-OS 33 15 334, DE-OS 41 10 302, DE-OS 41 10 304, DE-OS 44 03 755, DE-OS 44 41 263, German patent applications 196 06 701.4, 196 06 702.2, 196 06 703.0, 196 05 153.3 and DE-OS 44 17 488 and DE-OS 44 03 755.

Particularly good atomization as well as very effective emptying of the nozzle channel are achieved if the medium pump, for example a thrust piston pump, is again topped by a second pump stage, in particular a bellows pump. After leaving the medium pump, the medium is once more accelerated in it by contracting the pressure chamber. The pressure chambers of the medium pump and of the additional pump stage are contracted simultaneously. The jacket of the pressure chamber of the pump stage can form a return spring. For example, for the germ barrier or for the seal of the medium outlet. The pressure chamber of this pump stage or the associated end of the return spring can directly or in one part connect to a control plunger for the outlet closure.

This results in a very compact construction. These components as well as the holding device for the return spring or the like can be located substantially completely within the outlet stud. Transverse surfaces, provided for actuating the dispenser by manual pressure, protrude over the outer circumference of the upstream end of this stud. The stud is suited for insertion into an opening of the body, such as a nostril.

Besides from the claims, also from the description and the drawings these and further characteristics will be aparent, whereby the individual characteristics, the protection of which is being claimed, can be realised singly or multiply in the form of subcombinations for one version of the invention and in other fields, and can portray versions that are advantageous and in themselves protectable.

The subdivision of the application into individual sections as well as intermediate headings does not restrict the statements made therein in their general validity.

BRIEF DESCRIPTION OF THE DRAWINGS

Examples of the invention are shown in the drawings and explained in detail below. In the drawings are:

FIG. 1 an axial section of a dispenser,

DESCRIPTION OF THE PREFERRED EMBODIMENTS

Figure 2:
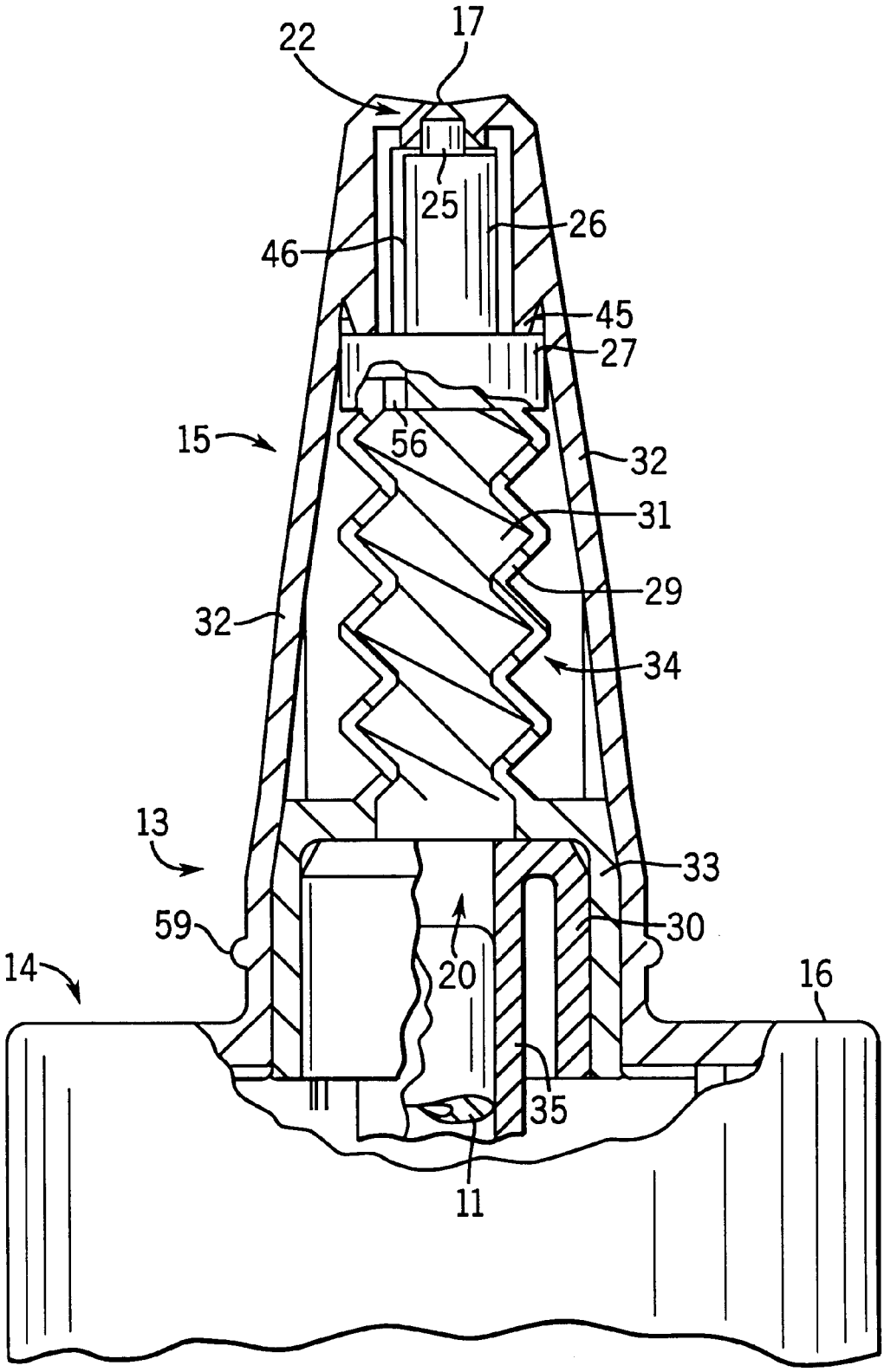
FIG. 2 another version of a dispenser.

The device 1 has two units 2 and 3. In order to actuate delivery they can be axially moved towards each other whilst contracting the dispenser 1. Upon release of the actuating stress they return by means of a spring in the opposite direction to the initial position according to FIG. 1. Unit 2 includes a bottle-shaped reservoir 4 with a narrowed reservoir neck 5. A thrust piston pump 6 is axially inserted into it. It sucks the medium from the reservoir belly. Pump 6 only partially projects, albeit with the major section of its length, into the dimensionally rigid reservoir 4. It is supported at the front and end surface of the neck 5 in a pressure tight and pre-tensioned manner with an intermediate seal 8 by means of a radially projecting, annular flange 7. A holder 9, namely a crimp ring made of soft metal plate, is provided for axial pre-tension and as protection for the positionally secured joint between reservoir 4 and pump 6. All the said components are located in a common axis 10.

Pump 6 has an actuating plunger 11, which outside the reservoir 4 axially projects out of its base body, namely the pump casing 12. Unit 3 is positionally fixedly connected to it. Within casing 12 member 11 bears a pump plunger. It borders a pump or pressure chamber on a front side. Thus the actuating motion constricts the pressure chamber and the medium contained therein is ejected through the inside of ram 11 into unit 3. Within casing 12 an outlet valve, which opens and re-closes in a pressure-controlled or path-dependent manner, can be provided, for example on the movable plunger unit. Thus the medium can only flow out of the pump chamber in the outlet direction after a predetermined pressure has been reached in the pump chamber. The outlet channel of the pump, however, can also always be opened in a valve-free manner from the pump chamber to the outlet opening of the pump, which lies in the final surface of ram 11. With the return stroke of the pump the medium is sucked through that end of the casing 12 or of a riser tube, which lies in the reservoir 4, and into the pump chamber via an inlet valve. That closes upon the pump stroke. Bodies 4, 8, 9 and 12 form when in operation a dimensionally stable as well as pre-assembled unit. Unit 3 can be mounted on it only by an axial movement extending up to a stop position.

Unit 3 has a one-piece body 13. It partially or completely overlaps parts 5 to 9, 11, 12 in each position on the outer circumference with a casing 14 and/or a stud 15. Cap-shaped casing 14 has a jacket that freely projects counter the outlet direction. This casing jacket encloses the aforesaid parts. It can be radially guided with radial play on the outer circumference of holder 9. At a distance from the end of casing 14, which lies outside reservoir 4, and opposing this, casing 13 has a front wall that directly connects to the cap jacket and extends only radially inwardly. The cap jacket does not project over the outside of this front wall. Adjacent to both sides of and around stud 15, this outside forms a shoulder or handle 16 in order to support the user's finger when actuating. Her/his thumb can then for example be supported remote from this on the bottom of the reservoir 4. As a result the dispenser 1 can be carried and simultaneously actuated with one single hand. The connection stud 15, which in comparison with the casing is longer and reduced in its outer width, connects in one part to the cap front wall of casing 14. It is tapered towards its free end and provides in its free end face the medium outlet 17. At that the medium completely frees itself from the dispenser 1 during delivery. A pressure tight coupling 18 is provided within casing 14 as well as within stud 15. It serves for axially rigidly, but mutually twistably connect unit 3 with ram 11 of the plunger unit. During the pump stroke and immediately after leaving the initial position, coupling 18 also forms the only connection between units 2 and 3 as well as a barrier against germ penetration into the medium duct. Each one of parts 13 to 18 can also be coaxial with axis 10.

Dispenser 1 is suitable for delivering liquid, pulverulent, pasty, gaseous or similar media. They are intended to be applied with the delivery as a cosmetic, pharmaceutical, technical or similar hormone. Medium chambers are provided for picking up and channelling the medium during delivery and when refilling. They are formed by storage chamber 19 of reservoir 4, by the pump chamber and all those chambers, the bounderies of which come into contact with the medium during operation.

From the pump chamber to outlet 17 these medium chambers form a medium duct 20 in the form of consecutively connecting duct sections. In comparison with the storage chamber and the pump chamber these ducts are significantly constricted in cross-section and lie within unit 3. In addition, a fluid duct 21 separate from duct 20, is provided. Here it forms a channel connection between environmental air surrounding dispenser 1 and the storage chamber 19. It adjoins the latter whilst bypassing the inside of casing 12 via the opening of neck 5 within holder 9. Therefore, the fluid here is air, but it could also be another fluid. It is intended to be capable of compensating any deviations in pressure inside chamber 19 vis-á-vis atmospheric pressure. Such deviations result as negative pressure, particularly when a further delivery volume is drawn off into the pump chamber from chamber 19 with the dosing pump 6 within a short time. Then, this negative pressure is again increased over a lengthier time by air subsequently flowing through unit 3 and duct 21 at a significantly throtteled rate.

A germ barrier 22 is provided in the vicinity of outlet 17 or of the front wall penetrated by outlet it. When the device 1 is at rest, it prevents germs contained in the atmospheric air, which settle on the end of stud 15 in the area of outlet 17, being able to penetrate inwards into duct 20. Barrier 22 is a mechanical barrier or a duct closure. It is open during discharge of medium out of the outlet 17. At the end of this discharge it closes again immediately. A similarly effective, but differently functioning germ barrier 22 is provided for duct 21 and operates as a germ filter. This barrier 23 lies between flange 7 and the end of neck 5 completely within holder 9 and cap 14 in an annular area around axis 10 and around casing 12. It connects closely to the outer casing circumference as to the end of neck 5 in a pressure-sealed manner.

A control body or slide 24 is located completely within the pipe-shaped stud 15 and can be axially displaced with respect to stud 15 only over a few tenths of a millimeter. In its initial and closing position body 24 is stop limited and coaxial with axis 10. The end of the dimensionally stable, one-part slide 24, which is closer to outlet 17, forms a cylindrical valve member 25 with an end face that is continuously planar and oriented at right angles to axis 10. In comparison with all other areas of slide 24 it has the smallest diameter. The length of member 25 is at most as large as its outer width. Member 25 connects to an extended mandrel 26 of slide 24 via a planar annular shoulder. At an axial distance from member 25 as well as in the area of the outer half of the length of stud 15, mandrel 26 adjoins an actuating member, namely a control plunger 27. The cup-shaped plunger 27 has a jacket-shaped plunger lip which freely projects over a washer-shaped annular plunger bottom in the outlet direction. Plunger lip is sealingly slideable on the inner circumference of control cylinder and bounds with the outer circumference of the mandrel 26 an annular chamber around axis 10. In an upstream direction a section of mandrel 26, connects to the plunger bottom, which section is extended in comparison with the section that lies downstream. This section is displaceably guided with an annular, plunger-like seal 28 on an inner circumference of duct 20. Seal 28 projects freely as a piston lip in a direction counter the outlet direction. This mandrel section, which projects beyond seal 28 in an upstream direction, is traversed by a channel 31 of duct 20 over its entire length. It also traverses the plunger bottom. Thus it issues into the annular chamber bounded by plunger 27. From the plunger bottom to the seal 28, channel 31 is circumferentially entirely bounded by slide 24. Upstream from seal 28, the channel 31 is open along a longitudinal side or on the outer circumference of the slide 24. In this area it is enveloped by a return spring or valve spring 29. Spring 29 is positionally rigidly supported with its upstream end on unit 3 and with its downstream end within seal 28 on the slide 24. Helical spring 29 loads slide 24 towards closing position. Parts 25 to 28 of slide 24 are made in one part. Spring 29 firmly holds member 25 in the closing position under pre-tension.

A body 30, located entirely within body 13 is inserted into stud 15 in a fixed position from the open upstream end of unit 3 or of casing 14. Body 30 is only attached to the inner circumference of the outermost jacket 32 of stud 15. For this body 30 has a widest jacket or section 33. Subsequent to casing 14 and axially stop limited section 33 engages the inner circumference of jacket 32 over a partial length of stud 15. This inner circumference also forms the sliding track for plunger 27. A freely protruding section or jacket 34 of body 30 connects to jacket 33 in upstream direction. Jacket 34 is contact-free with respect to jacket 32. Jacket 34 is located at a small distance from the bottom base of plunger 27 and envelopes the associated section of mandrel 26, channel 31 and spring 29. The latter is supported within the frontal wall of section 33 and directly on body 30. Seal 28 is slidigly guided, on the inner circumference of jacket 34. Body 30 forms a coupling member 35 of coupling 18. Sleeve-shaped member 35 lies with a radial spacing within jacket 33. Member 35 is axially stop limited and envelopes the final section of ram 11. Member 35 makes the connection between units 2 and 3. Member 35 bounds that section of duct 20 which connects to ram 11.

An annular chamber, which communicates with the interior of casing 14 and with duct 21, is bounded between sleeve-shaped members 33, 35 that lie in one another. Via a channel 36 this annular chamber is connected to that annular chamber, in which plungers 27, 28 lie and which is bounded by the inner circumference of jacket 32 as well as by the outer circumference of jacket 34. The axial and narrow channel 36 provides the only external link to this annular chamber. The medium does not flow through this chamber. Positional changes of slide 24 do therefore not result in significant pressure changes in this annular chamber.

A swirling or twisting device 37 is provided in the transition area between members 25 and 26. It puts the medium, which is flowing along the outer circumference of mandrel 26 in the outlet direction, in a rotational flow around the axis 10 of outlet 17 and of member 25. This rotational flow continues during delivery up to the outlet 17. Within the front 43 of stud 15 an annular valve seat 38 is allocated to the sharp annular edge flanked at right angles between the circumferential surface and the end face of member 25. The annular edge including a closure face contacts seat 38 only under the tension of pressure spring 29, when in closing position.

Outlet 17 is formed by the outer end of a cylindrical channel 39. With sharp edges channel 39 can adjoin the outer end face of front wall 43 in the vicinity of a recess in this end face. Thus resulting in a sharp tear-off edge for the atomized separation of the medium at the outlet 17. The length of nozzle channel 39 is at most as large as its diameter which is less than four tenths or one tenth of a millimeter. This length can also be smaller than half this diameter.

An upstream conically extended channel section 40 adjoins the inner end of channel 39. Its extended end directly adjoins a cylindrical channel section. On this section member 25 with its outer circumference is guided in a sealed but sliding manner. The transition of the cylindrical section to section 40 forms seat 38. In comparison with its diameter or half of its diameter this cylindrical channel section is shorter. With its upstream end the cylindrical channel adjoins an extended channel section 41. Section 41 envelopes member 25 on its outer circumference in every position and is traversed by member 25.

Conical section 41 lies within an annular protrusion 42 which freely projects over the inner end face of the front wall 43. The upstream end face of ring 42 lies in the closing position with a slight gap spacing from the face located between members 25 and 26. Thus the closing position on seat 38 is not impeded. Device 37 can be formed by means of a recess or profile shaping in the shoulder surface between members 25 and 26. Device 37 can adjoin the outer circumference of mandrel 26 and dispense the medium in a twisting flow to section 41.

The outer diameter of member 25 is at most four or three times as large as the diameter of nozzle opening 17 and at most half as big as the outer diameter of the subsequently connecting mandrel section 26. Channels 44 of duct 20 are provided along the outer circumference of mandrel section 26. They are bounded by the inner circumference of jacket 32 as well as by the outer circumferences of sections 26 and 42. They are therefore permanently connected to extension 41 as well as to device 37.

These longitudinal channels 44 connect the inner annular chamber of the plunger 27 with valve seat 38. The closing surfaces of valve 22 only have linear contact with each other. However, they are supplemented up to the extension 41 by means of the cylindrical sealing surfaces which connect upstream. Channels 44 can be formed by grooves on the inner circumference of jacket 32. They continue into an annular protrusion which freely projects in the upstream direction into the annular chamber or plunger 27. Hence here also relatively narrow discharge cross-sections are achieved. These cross-sections remain narrow up to outlet 17. They are significantly smaller than the discharge cross sections of channel 31 or of member 35. On its outer circumference mandrel section 26 can be provided with a flattened zone that reaches to member 25, with recesses 47 that lie at a distance to member 25 or with the like. In this way swirling of the medium during discharge is further improved.

The one-part crimp ring 9 has two adjacent longitudinal sections 48 and 49 of differing width. They are connected to each other by means of an annular washer-shaped front wall. As with this, they have a throughout a constant wall thickness. The extended cap-shaped section 48 serves to pre-tension flange 7 against the end face of neck 5. This end face can be formed by an annular radial protrusion at the end of neck 5 and directly connects to the inner neck circumference. Section 48 rests with its front wall directly on the annular surface of flange 7. With a final collar that is angled inwards section 48 rests on a shoulder surface that is turned away from the end face of neck 5 and that is provided by the outer circumference of neck 5. Shown on the right in FIG. 1 is the finally assembled, crimped as well as axially secured position and on the left in FIG. 1 the position before crimping and after ring 9 has been inserted in an upstream direction.

In this position the inner circumference of section 48 lies at a slight distance from the outer circumference of a radially outwardly projecting annular collar of neck 5. This projection forms the shoulder surface for the shrink ring 9. The cylindrical section 49, which connects in a downstream direction to the inner circumference of the front wall of section 48, envelops that part of casing 12 which projects outwardly over flange 9 and out of neck 5. This part is formed by a separate lid or cover of casing 12, which cover is positionally fixed slidingly traversed by ram 11.

Section 49 closely but not sealingly envelopes the outer circumverence of this cover part of casing 12 up to its end face which is traversed by ram 11. Thus duct 21 is bordered gap-like by the inner circumference of section 49 and by the outer circumference of this casing section. Duct 21 can also be gap-like bounded by the outer circumference of the neck collar and by the inner circumference of section 48. Thus air can enter the extended annular chamber, which houses components 7 and 8, from both ends of crimp ring 9. From there air reaches chamber 19 only via barrier 23.

By means of a device 50, units 2 and 3 as well as the germ barrier of coupling 18 are secured against being pulled apart opposite to the actuating direction and to thereby being detached from each other. The pull-off preventing device 50 lies completely within unit 3 and casing 14 at an upstream distance from the cap front wall of casing 14. Safety device 50 is located on the outer circumference of the outer section of casing 12, approximately in the middle between flange 7 and the cap front wall of casing 14. A safety member 51 is formed by the crimp ring, namely the downstream end of section 49. In cross-section this end is bent radially outwards by more than 90° in a hook or conical shape. It therefore projects over the outer circumference of cylindrical section 49. A counter member 52 is made in one part with body 13. It is radially resiliently movable or reversibly extendable against inherent spring stresses. Thus it engages behind the dimensionally stable member 51 as a cam. It also lies at a slight distance from the outer circumference of section 49. When actuating the pump, it can be axially shifted along this outer circumference. In so doing it detaches from member 51. Member 52 is located on the inner circumference of the free end of protrusion 53 or jacket. This projects within the cap jacket 14 and at a radial distance from this less far from the inside of the cap front wall than the cap jacket. For increasing resiliency, member 53 can include one or several axial slots.

When slipping unit 3 onto unit 2 the annular snap cam 52 runs onto the uninterrupted annular member 51. As a result cam 52 is expanded against spring stress of jacket 53 until it has been completely moved past member 51 and then it springs back into its safety position. When applying a very great tensile force to units 2 and 3 the safety device 50 can accordingly but inversly be disengaged. Thus units 2 and 3 can be detached from each other. The mutual contact of members 51 and 52 is not sealed in the initial position. Thus air can pass between them and they also form boundaries of duct 21.

Barrier 23 or seal 8 includes an annular or dis-shaped germ filter 54. This directly connects to the end face of neck 5, which is made of glass, as well as to the outer circumference of casing 12 with axial or radial pre-tension. Filter 54 can for example be made of semi-permeable, porous material. This slowly lets air pass towards chamber 19. In the opposite direction, however, it lets medium not permeate out of chamber 19. It therefore serves as a medium seal, not however as a fluid seal. The air penetrates from the chamber located within section 48 into the end face and the circumferential surface of filter 54. Then it flows radially inwards within filter 54 and then between neck 5 and casing 12 via the associated end face of filter 54 into chamber 19. An annular or disc-shaped seal 55 can be additionally provided on the outer face of filter 54 between this and flange 7. The outer diameter of seal 55 is appropriately smaller than that of filter 54. Seal 55 is air-tight. Filter 54, however, can also directly adjoin flange 7 without additional seal 55.

For operating the dispenser 1 unit 3 is pushed over unit 2 via a pump stroke with fingers on both sides of stud 15 on handle 16. Thereby the pump chamber contracts. The associated outlet valve is opened after an initial partial stroke and the medium is pressed from the pump chamber through the channel in ram 11 into duct 20. From here the medium flows in axis 10 through member 35, spring 29 and the channel 31 onto the downstream end face of the plunger 27 and into the associated annular chamber. As a result an overpressure is built up here.

When a limiting pressure is reached, the one-part unit 24 is pressed in an upstream direction against the resistance of spring 29, without abutting the end of jacket 34. As a result valve member 25 is lifted from seat 38 until its closing edge lies freely within extension 41. The medium can now successively flow through channels 44, along the shapings 47 and 37 and into channel section 41, in which it flows along the outer circumference of member 25, whilst increasing in flow speed because the flow cross sections are reduce by section 41 in the flow direction.

The closing edge of member 25 forms an annular nozzle with section 41 and the cylindrical channel section connecting to it. The medium is pre-atomized in this nozzle. Then it flows along the cylindrical channel section into section 40. As a result of the cross-sectional reduction of section 40 the flow speed increases once again. The medium now in a twisting flow then enters nozzle channel 39. Under repeated, even finer atomization it detaches itself from the bordering edge of outlet 17 as atomizing cone. All channel sections 39 to 41 as well as the cylindrical channel section that lies between them are commonly bounded in one part. They lie within front wall 43. Their common length can correspond to a width of section 41.

As soon as the pressure in the pump chamber or chambers 19 and 20 has sunken sufficiently, control member 34 returns commonly with member 25 in the outlet direction into its closing position. Member 25 penetrates in a thrusting-like motion into the cylindrical channel section. In so doing, its closing edge forms a valve control edge commonly with the narrower end edge of section 41. Thus when reaching this end edge, the downstream channel section is sealingly closed with respect to the upstream channel section 41, 44, 31. Member 25 now functions as an ejecting plunger. This completely expels the medium out of the cylindrical channel section and sections 40, 39 again under atomization. Namely until the closing edge rests against the seat 38 with high surface pressure and until sections 39 and 40 are completely emptied. Section 39 can be shorter than section 40. The latter is at most as long as section 41 or shorter.

If handle 16 is released beforehand or now, unit 3 returns to its initial position. A spring, such as a pressure spring, located in the pump chamber and acting on the plunger unit, can be provided for this. As a result medium is subsequently drawn into the pump chamber from chamber 19 with the outlet valve closed. In this way, negative pressure arises in chamber 19. As a result chamber 19 draws in atmospheric air at a very delayed flow rate. Namely successively through filter 54, holder 9, the end thereof, safety device 50, jacket 53, the inner chamber of casing 14 as well as the free end thereof and/or channel 36. And this for the time until the pressure in chamber 19 is only slightly below the atmospheric pressure. Therefore, germs can neither penetrate into chamber 19 nor channel section 41 nor the channel sections that lie in between. The closing edge of member 25 can have a scraping effect on the cylindrical channel section during closing motion. In this way medium residues are there also removed in outlet direction. As a result of the pushin effect of plunger 27 practically no medium residues are any longer to be found in sections 39 and 40, either. It could otherwise be contaminated by germs.

With the embodiment according to FIG. 2 the slide 24 including telescopically interengaging jackets 32 and 34 is not necessary. Instead of an elastically retractable and extendible component 34 is provided. This also forms spring 29 and bounds channel 31 along its entire length and over its entire circumference. Spring 29 reaches from the exterior of the bottom wall of plunger 27 to the washer-shaped front wall of snap-in body 33. Members 27, 29, 33 are made in one part. Spring 29 has a constant wall thickness over its circumference and its length. The spring jacket, however, forms—as with a helical coiled spring—one or two full helical coil turns that intersect. Thus the outer circumference is designed complementary to the inner circumference with a coarse pitch like a pitch gradient of at least 30° or 45°. The largest outer diameter respective the smallest inner diameter is constant over the entire length of spring 29. The smallest inner diameter is less than 5 or 3 or 1.5 mm. The outer circumference of spring 29 directly opposes the inner circumference of jacket 32 without contact. Coupling body 30 with an outer jacket axially abutted in a fixed position is inserted into jacket 33 from the end remote from spring 29 as well as from the open end of casing 14. The inner jacket, which lies at a radial distance from the outer jacket, forms the coupling member 35 of body 30.

Within channel 31 the bottom wall of plunger 27 is eccentrically traversed by an axial passage channel 56. This issues into the annular control chamber of plunger 27 or into channels 44. After leaving ram 11 the medium flows solely within channel 31. This imparts a helical twisting flow to the medium as a result of the inner channel shaping. The flow then passes through channel 56, which is considerably narrower in comparison to channel 31, along the guide surface 46 to the pressure side of plunger 27 and from there to outlet 17. Component 34 is a bellows. Its inner chamber 31 constricts when valve 22 opens and contributes to the acceleration of the flow. Whilst valve 22 closes the volume of chamber 31 is enlarged again. Thus medium is drawn back out of channel sections 41, 44 and 56 and therefore removed from the area of valve 22.

Figure 3:
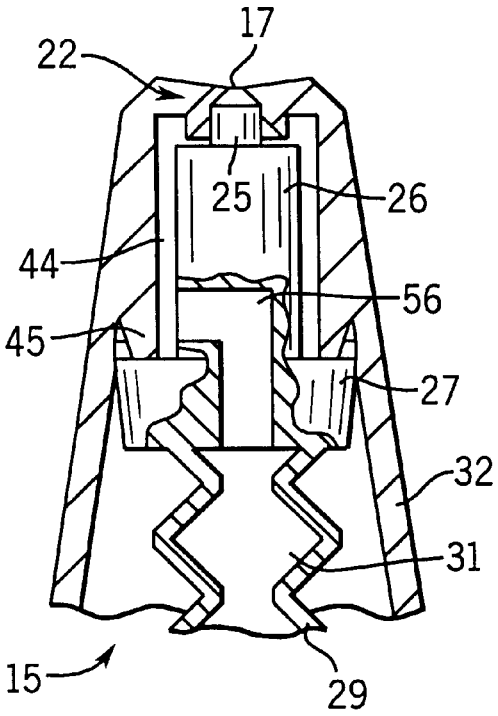
FIG. 3 another version of the sealing member.

According to FIG. 3 the diameters of spring 29 are significantly smaller. Channel 56 is annular. Its leg, which connects to channel 31, lies in axis 10 of channel 31. The other leg traverses the guiding surface respective the outer circumference of mandrel 26 between the ends of channel 44 and away from plunger 27.

Figure 4:
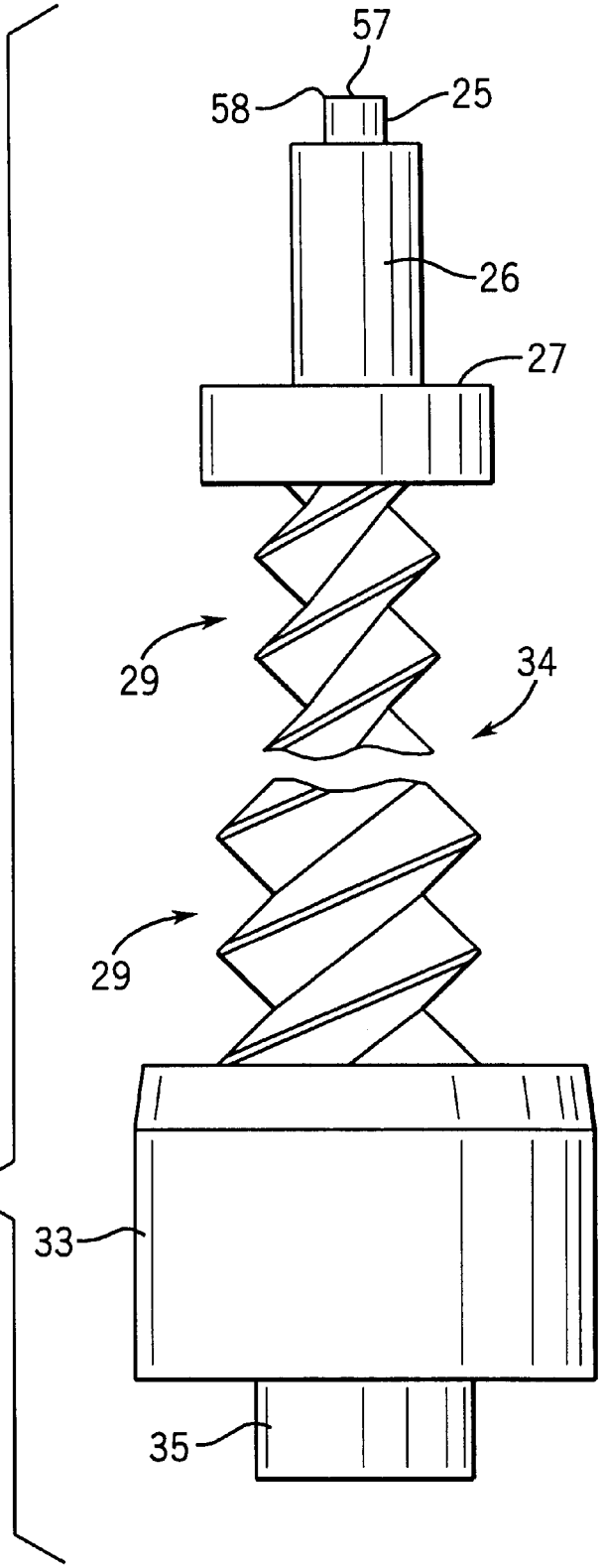
FIG. 4 a view of a structural body of the dispenser according to FIG. 2 and 3, FIG. 5 an enlarged section of FIGS. 1 to 3

In FIG. 4 the one-part-unit including members 25 to 27, 29 and 33 according to FIGS. 2 and 3 is shown. Spring 29 according to FIG. 2 is shown connecting to jacket 33 and spring 29 according to FIG. 3 is shown connecting to plunger 27—in each case only indicated with a partial length. Prior to mounting on unit 2 this one-part unit is inserted into body 13 and through jacket 53 and cam 52 into stud 15. Beforehand or afterwards body 30 is inserted in the same direction. Jacket 33, which consists of a relatively gently resilient material, is radially pre-tensioned with respect to the inner circumference of jacket 32 with body 30. According to FIG. 4 mandrel 26 is cylindrical over its entire length. It is not provided with a flattened zone 46 or with shapings 37 and 47. In FIG. 4 the closing edge 58 of member 25, which edge adjoins the end face 57, is shown. The outlet valve of pump 6, which bounds the pump chamber, can be pressure adjusted. Thus it also opens if the pump chamber is filled only with air and if pump stroke is performed. The air chamber then reaches uninterruptedly from the pump chamber to closing seat 38, 58. Thus a very simple priming of the pump is achieved when setting again an operation. Thereby all channel chambers can easily be filled with medium.

While inserting body 30 similar to a piston cannel 36 also serves to vent the annular chamber, which connects to plunger 27, and is located inside stud 15. Via channel 36 this annular chamber can also be put under over pressure with a test device. This pressure acts on plunger lip 27. Thus the sealing contact of lip 27 can be detected on account of a pressure drop in the annular chamber. The flattened zone or other means can prevent the ends of spring 29 against mutual torsion around axis 10 and with respect to body 13. As a result of the helical shape torsional tension is also built up with the axial shortening of spring 29. It superimposes and supplements the axial tension during back springing. Thus short closing times are achieved. A cap (not shown) is provided to entirley receive stud 15 during rest periods. It covers outlet 17 at a slight distance and reaches to handle 16. It fits tightly on a bead 59 on the outer circumference of stud 15. Thus germ penetration is prevented or hindered.

Figure 7:
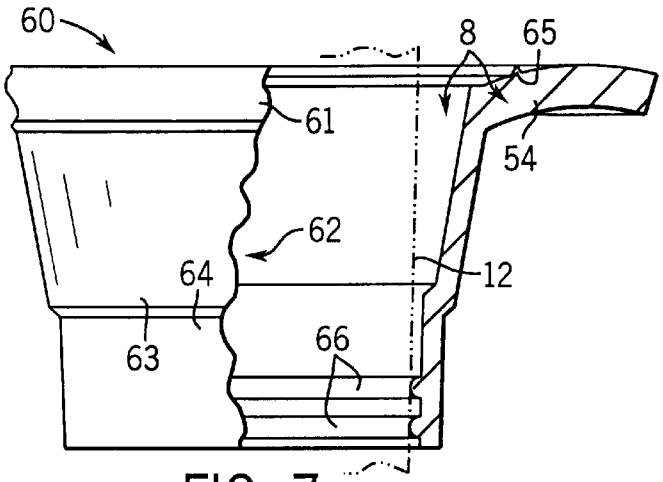
Figure 6:
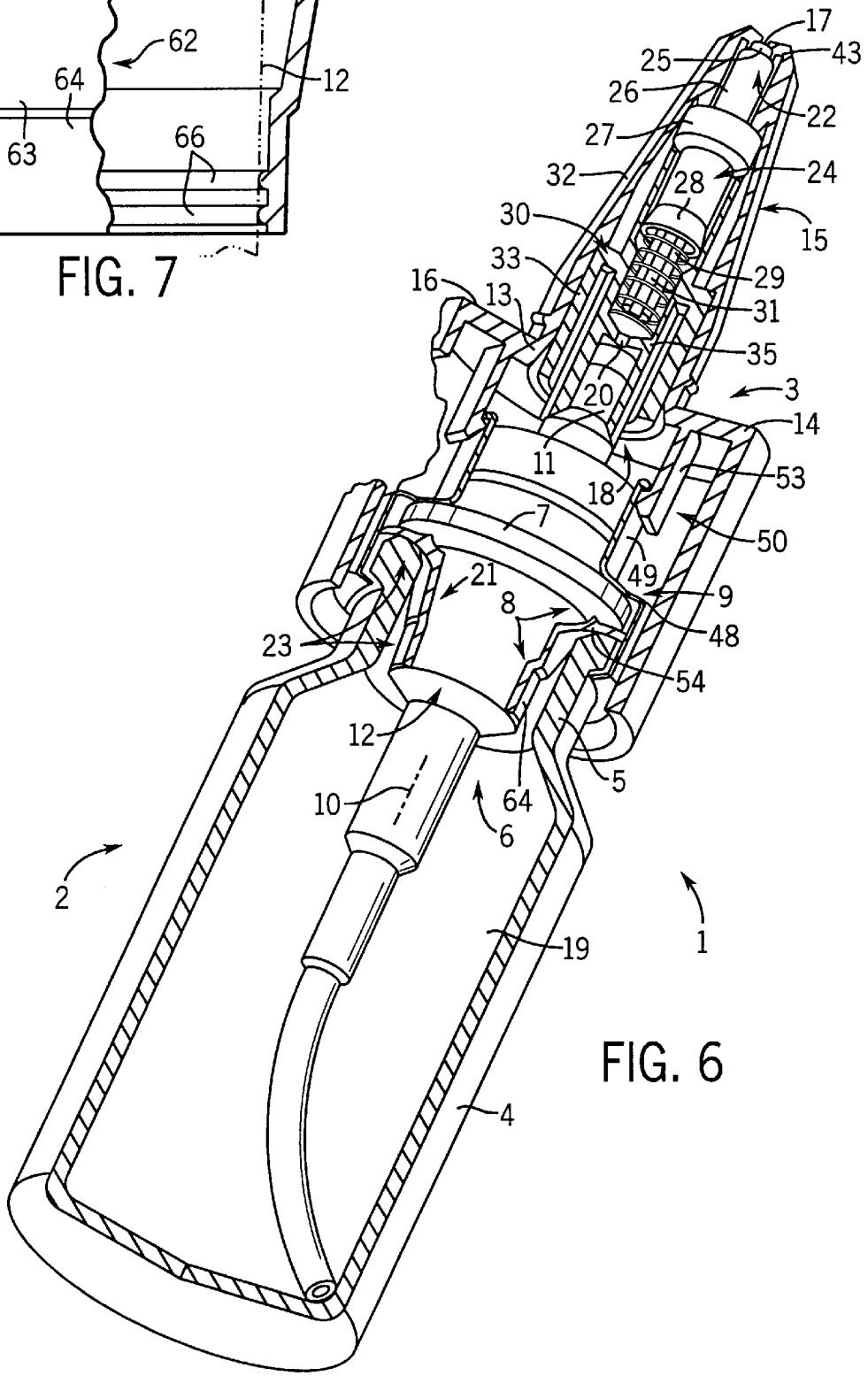
FIG. 6 another embodiment of a dispenser in a perspective and angled sectionally opened view of individual components, and FIG. 7 a structural part of the dispenser according to FIG. 6 in a radial and partly cross-sectional view.

According to FIG. 6 and 7 seal 8 or barrier 23 can also be axially extended beyond the gap between neck 5 and flange 7. This can apply solely to seal 8 or solely to barrier 23. However, the body 60 provided for this can also serve both as a filter or germ filter and as a seal and can be made in one part entirely. Body 60 can contain anti-bactericides which bring about the extinction of the germs by contact. The extension of body 60 is provided only in an upstream direction.

The sealing or filtering body 60 has an annular flange 61. This lies, as with parts 54 and 55, axially tensioned between the end faces of neck 5 and flange 7. In an unstressed state flange 61 in the axial section is curved on each side of axis 10. Thus it forms a convex curvature side for contact with flange 7 and a concave curvature side for contact with neck 5. The concave side provides an annular groove over the entire circumference of flange 61. An axially projecting sealing lip 65 is provided on the convex curvature side at a larger distance from the outer circumference than from the inner circumference of flange 61. In cross-section lip 65 is flanked at angles and is flattened on flange 7 as a result of the tensioning with the ring 9. As the face sections radially adjoining lip 65 on both flank sides, this lip 65 then adjoins flange 7 under increased bearing pressure with respect to the said face sections. Both faces of flange 61 are thus planar when in sealing position.

A jacket section 62 axially connects in one part only to the inner circumference of flange 61. For the most part of its length or entirely section 62 has a wall thickness, which is at least a third or a half smaller than the wall thickness of flange 61 and is below 1 mm or 0.7 mm. Jacket section 62 has a length section 63, which directly adjoins flange 61, and a longitudinal section 64, which only adjoins section 63. Sections 63, 64 freely extend in upstream direction into neck 5 or chamber 19. The acutely conical section 63 is more greatly narrowed in this direction than section 64. The latter can have the same conicality over the length of its inner circumference as the associated section of casing 12. Thus entirely over its length and its circumference section 64 is directly adjacent to the outer circumference of this casing section. The length of section 64 corresponds to a distance of between at least a third and a half of its inner diameter. The inner circumference of section 64 passes, as does its outer circumference, via a step into the extended inner respective outer circumference of section 63, which like flange 61 is completely contact-free with respect to casing 12.

At a slighter distance from the free end than from section 63, the inner circumference of section 64 has two sealing lips or sealing beads 66. They extend uninterrupted annularly and project over the inner circumference by less than one tenth of a millimeter. in axial cross-section each bead 66 is of graduated dial shape and extends over an arc angle of more than 120°. Due to radial pressure against casing 12, each bead 66 will be pressed into the enveloping adendum of the adjoining inner circumference. The clear distance between the beads 66 is at the most as large as axial extension of each singel bead 66. the distance of the bead adjacent to the free end face of section 64 and from this end face is smaller than the named axial extension. The outer circumference of casing 12 is free from any recesses in the contact area of the beads 66, namely in the area between these beads 66 and over the entire length of section 64. Thus beads 66 do not engage in any recesses. They rather rest on the smoothly, uninterrupted and in upstream direction acutely narrowed outer casing surface up to a shoulder, via which the casing 12 continues in an upstream direction into a more narrow casing section. Venting of chamber 19 can take place along the exterior of casing 12 according to FIG. 1 or via the inside of casing 12. In the latter case the air flows along ram 11 into casing 12 and leaves again in the vicinity of section 63 via a casing opening and in a direction towards the inner circumference of jacket 62. It then flows into section 64. This is radially spring-expanded under the pressure of the fluid so that lips 66 lift off from casing 12 and let the air flow into chamber 19. In this way a venting valve, that operates in a pressure-dependent manner, is provided. Prior to achieving complete pressure compensation lips 66 return again to their closing position radially inwards whilst narrowing the entire section 64.

In the first case filter 54 can be placed between flanges 7 and 61, whereby the air also first enters section 63 and then section 64. Body 60 is made, from plastic material, namely of a material that is elastic with regard to elongation, compression and bending. Lips 66 can form the associated germ barrier. Lip seal 60 protects against diffusion of the medium into the open and out of chamber 19. For pressure compensation in chamber 19 the seal 60 opens even in case of a slight negative pressure and respectively a pressure, which is only slightly lower than the atmospheric pressure. Filter membrane 54 is protected from contact and moistening with the medium, since a dry chamber is bounded between lips 66 and flange 7 within jacket 62 by body 12 and seal 60. No medium penetrates into this dry chamber from chamber 19. Additional to these functions the seal 60 also forms the closing seal for the reservoir 4.

All features of all embodiments can be combined with each other. All the specified effects and characteristics can be provided precisely as described, only approximately or substantially as described or even in a greatly differing manner.

We claim:

1. A media dispenser comprising:

a first base unit (2) operationally bounding a medium chamber (19) which operationally defines a chamber pressure;

a second base unit (3) connected to said first base unit (2);

a medium duct(20) including a duct end, said duct end providing a medium outlet (17) on said second base unit (3);

a fluid duct (21) bypassing the medium duct (20) and operationally communicating with the medium chamber (19) for compensating for the chamber pressure inside said the medium chamber (19);

a closure (22) for closing said medium duct (20) close to said medium outlet (17) against entry of contaminants, said closure (22) being transferable between an opened position and a closed position; and an annular microbic barrier (23) situated in said fluid duct (21) for preventing microbic contamination of the media contained inside said dispenser (1), said dispenser extending along a longitudinal axis and said microbic barrier (23) lying transverse to said longitudinal axis of said dispenser.

2. The media dispenser according to claim 1, wherein said dispenser (1) is assembled and composed from first and second base units (2, 3) for expelling the media, said second base unit (3) being manually displaceable with respect to said first base unit (2), locking means (50) including a second locking member (52), said locking means being provided for preventing separation by mutual withdrawal of said first and second base units (2, 3), said second base unit (3) being displaceable over an actuating motion, said second base unit (3) being freely exposed and including said medium outlet (17), and an actuating handle (16) for manually depressing said second base unit (3) with respect to said first base unit (2) and the second locking member (52) of said locking means (50).

3. The media dispenser according to claim 2, wherein said first base unit (2) includes a subunit (11) displaceable over said actuating motion, thereby said first base unit (2) being capable to expel the media under pressure and independent from second base unit (3), said second base unit (3) including a connector (35) rigidly connected to said subunit (11) and made in one part with an intermediate sleeve (33) spacedly enveloping said connector (35).

4. The media dispenser according to claim 3, wherein said second base unit (3) is operationally connected with said first base unit (2) exclusively by a substantially linear plug-in connection (11, 35 and 51, 52).

5. The media dispenser according to claim 4, wherein an annular closure holder (9) is provided for connecting a chamber closure (8) with a reservoir (4) bounding said medium chamber (19), said closure holder (9) internally bounding said fluid duct (21).

6. The media dispenser according to claim 5, wherein said closure holder (9) includes a crimp ring for fixedly connecting a medium pump (6) to said reservoir (4).

7. The media dispenser according to claim 5, wherein said closure holder (9) includes an upstream sleeve end remote from said closing means (22), said closure holder (9) including a first locking member (51) engaging said second locking member (52) for preventing said second base body (13) from being pulled off from said reservoir (4), said first locking member (51) being located closer to said medium outlet (17) than said upstream sleeve end, said second locking member (52) being permanently spacedly enveloped by a jacket.

8. The media dispenser according to claim 7, wherein a discharge actuator including said actuating handle (16) is provided for manually repeatedly dispensing the medium, said first and second base units (2, 3) and said discharge actuator commonly including first and second base bodies (12, 13), for actuating said discharge actuator said second base body (13) being axially and linearly displaceable with respect to said first base body (12) from an initial rest position into a stroke end position and back to said rest position, said closure holder including a fastening sleeve (9) rigidly connected to said first base body (12).

9. The media dispenser according to claim 8 and further including a media reservoir (4) and a thrust piston pump (6) including a pump casing, wherein said first base body includes said pump casing (12), said fastening sleeve (9) fastening said pump casing (12) to said media reservoir (4), a sealing component (54, 55) being interposed between said pump casing (12) and said media container (4), said sealing component (54, 55) being traversed by said fluid duct (21) which entirely externally bypasses said pump casing.

10. The media dispenser according to claim 6, wherein said closure holder (9) defines an outer holder circumference and a downstream sleeve end remote from said upstream sleeve end, said downstream sleeve end including a first locking member (51) in one part with said closure holder (9), said first locking member (51) projecting radially outwardly over said outer holder circumference, said second locking member (52) abutting said first locking member (51) exclusively in an initial state of said dispenser (1), one of said first and second locking members (51) being made from metal.

11. The media dispenser according to claim 10, wherein said second locking member (51) is a locking projection including a bend of said downstream sleeve end.

12. The media dispenser according to claim 1, wherein said closing means (22) include a closure member (25) displaceable coaxially with said medium outlet (17), when in said closed position said closure member (25) being located closer to said medium outlet (17) than in said opened position, said closure member (25) being openable by pressurizing said medium duct (20) with the media, said closure member (25) being closable by depressurizing said medium duct (20), said closure member (25) including a sharp closing edge (58) and being entirely countersunk within said second base unit (3).

13. The media dispenser according to claim 12, wherein said closing means (22) include a closure seat (38) said closure member (25) being reversibly displaceable between said closed position and said opened position, said closure member (25) including a closing face 57), a circumferential face and an end face, said circumferential face and said end face sharply intersecting to provide said closing edge, in said closed position said closing edge (58) hermetically resting against said closure seat and being resiliently forced against said closure seat (38) which envelopes said closing edge (58).

14. The media dispenser according to claim 13, wherein said closure member (25) includes a plug member, said circumferential face being an outer circumferential face subdivided by an annular shoulder spaced from said end face, said plug member (25) including an outermost downstream end providing said end face and said closing face (58), said medium outlet (17) being entirely bounded by a nozzle bound made in one part with said closure seat (38), said nozzle bound including an outer jacket (32) and an inner projection (42) spacedly enveloped by said outer jacket, said inner projection (42) freely projecting towards said end face and being made in one part with said nozzle bound.

15. The media dispenser according to claim 1 and further including a control piston (27) for operating said closing means (22), wherein said control piston (27) defines an external circumference and an internal circumference, stationary duct faces bounding said medium duct (20), said duct faces axially overlapping said external circumference and said internal circumference in substantially any position of said control piston (27).

16. The media dispenser according to claim 15 and further including a control piston (27) for operating said closing means (22), wherein said medium duct (20) includes a duct section (31) displaceable commonly with said control piston (27), said duct section (31) traversing said control piston (27) and being circumferentially entirely bounded by said control piston (27), a duct jacket (29) being provided and connecting upstream to said control piston (27).

17. The media dispenser according to claim 1 and further including a return spring (29) for operating said closing means (22), wherein said return spring includes a bellows jacket (29) profiled to provide a helical lead winding.

18. The media dispenser according to claim 17 and further including a control piston (27) for operating said return spring (29), wherein said bellows jacket and said helical lead winding substantially directly connect to said control piston (27) in one part.

19. The media dispenser according to claim 1 and further including a slendered discharge stud (15) freely projecting from said base body (13) and including a free stud end, wherein said medium outlet (17) traverses said free stud end, a return spring (29) being provided and including an upstream spring end, a fixing body (30) being provided for rigidly fixing said upstream spring end with respect to and inside of said discharge study (15), a medium pump (6) including an actuating ram (11) being provided, said fixing body (30) including a coupling member (35) separate from and directly engaging said actuating ram (11), said actuating ram (11) and said coupling member (35) commonly providing a germ-tight sealing connection.

20. The media dispenser according to claim 19, wherein said return spring (29), said fixing body (30) and said coupling member (35) are commonly made in one part.

21. The media dispenser according to claim 1 and further including a pump casing, a medium container (4) for refilling said pump casing (12) with the media and a sealing member (60) located between said pump casing (12) and said medium container (4) for sealing said fluid duct (21) with respect to said medium chamber (19) of said medium container (4), wherein said sealing member (60) includes a sealing sleeve (62) firmly enveloping said pump casing (12) and resiliently expandable for opening said fluid duct providing a venting duct for venting said medium chamber (19).

22. The dispenser according to claim 21, wherein said sealing sleeve (62) freely projects into said medium container (4) and defines an overall length extension including one third of said overall length extension, said sealing sleeve (62) externally closely resting against said pump casing (12) over at least said third of said overall length extension and being expandable by underpressure inside said member chamber (19).

23. The media dispenser according to claim 21, wherein said sealing sleeve includes a first sealing lip (66) and a second sealing lip (66) axially spaced from said first sealing lip (66), said first and second sealing lips (66) resting radially pretensioned against counterfaces of said pump casing (12) when said fluid duct (21) is closed, said counterface for at least one of said sealing lips (66) being free of edges that could contact said sealing lip (66).

24. The media dispenser according to claim 1, wherein said annular microbic barrier (23) includes an annular filter (54) coaxial with said dispenser (1).

25. The media dispenser according to claim 24, wherein said annular filter (54) is covered with a seal (55) nonpermeable to the media, said annular filter (54) and said seal (55) being commonly covered by a shield (48) made from metal.

* * * * *